US010695947B2

(12) United States Patent
Bilodeau et al.

(10) Patent No.: US 10,695,947 B2
(45) Date of Patent: Jun. 30, 2020

(54) COMPOSITE BUILDING PRODUCTS BOUND WITH CELLULOSE NANOFIBERS

(71) Applicant: University of Maine System Board of Trustees, Orono, ME (US)

(72) Inventors: Michael A. Bilodeau, Brewer, ME (US); Douglas W. Bousfield, Glenburn, ME (US)

(73) Assignee: University of Maine System Board of Trustees, Orono, ME (US)

( * ) Notice: Subject to any disclaimer, the term of this patent is extended or adjusted under 35 U.S.C. 154(b) by 385 days.

(21) Appl. No.: 14/446,712

(22) Filed: Jul. 30, 2014

(65) Prior Publication Data

US 2015/0033983 A1 Feb. 5, 2015

Related U.S. Application Data

(60) Provisional application No. 61/860,533, filed on Jul. 31, 2013.

(51) Int. Cl.
*B27N 3/04* (2006.01)
*B27N 3/00* (2006.01)

(52) U.S. Cl.
CPC ..... *B27N 3/04* (2013.01); *B27N 3/002* (2013.01)

(58) Field of Classification Search
CPC ..... B27N 3/04; B27N 3/002
USPC ..... 428/292.4
See application file for complete search history.

(56) References Cited

U.S. PATENT DOCUMENTS

| | | | | |
|---|---|---|---|---|
| 6,083,582 | A | 7/2000 | Chen et al. | |
| 6,117,545 | A | 9/2000 | Cavaille et al. | |
| 6,379,594 | B1 | 4/2002 | Dopfner et al. | |
| 7,381,294 | B2 * | 6/2008 | Suzuki | D21D 1/20 162/102 |

(Continued)

FOREIGN PATENT DOCUMENTS

| | | | |
|---|---|---|---|
| WO | 2009086141 | A2 | 7/2009 |
| WO | 2013061266 | A1 | 5/2013 |

OTHER PUBLICATIONS

Binding effect of cellulose nanofibers in wood flour board, Kojima et al., May 26, 2013, journal of wood science.*

(Continued)

*Primary Examiner* — Vincent Tatesure
(74) *Attorney, Agent, or Firm* — McMillan, Sobanski & Todd, LLC

(57) ABSTRACT

Building materials are generated by the simple mixing of cellulose nanofiber (CNF) slurry with typical wood-derived material such as wood meal, optionally with mineral particulate materials, and dried. Particle boards are made with wood meal particulates; wallboards are made with wood particulates and mineral particulates; paints are made with pigment particulates; and cement is made with aggregate particulates. The particle board samples were tested for fracture toughness. The fracture toughness was found to be from 20% higher up to ten times higher than the typical value for similar board, depending on the formulation. For cases of 20% by weight cellulose nanofibers and 80% wood, the fracture toughness was more than double that of typical particle board. The process sequesters carbon and oxygen into the building product for its lifespan—typically decades—and avoid releasing $CO_2$ into the atmosphere.

8 Claims, 3 Drawing Sheets

(56) References Cited

U.S. PATENT DOCUMENTS

| | | | | |
|---|---|---|---|---|
| 8,231,764 | B2 | 7/2012 | Husband et al. | |
| 2002/0059886 | A1 | 5/2002 | Merkley et al. | |
| 2002/0198293 | A1 | 12/2002 | Craun et al. | |
| 2005/0051054 | A1 | 3/2005 | White et al. | |
| 2005/0256262 | A1 | 11/2005 | Hill et al. | |
| 2010/0282422 | A1* | 11/2010 | Miyawaki | C08B 15/02 162/76 |
| 2012/0090800 | A1* | 4/2012 | Ture | B29C 70/465 162/164.1 |
| 2013/0000855 | A1 | 1/2013 | Nuopponen et al. | |
| 2013/0192778 | A1* | 8/2013 | Jabar, Jr. | D21H 17/67 162/135 |
| 2013/0312925 | A1* | 11/2013 | Saastamoinen | D21H 17/28 162/175 |

OTHER PUBLICATIONS

Improving Core Bond Strength of Particlboard Through Particle Size Redistribution, Sackey et al., Wood and Fiber Science, 40(2), 2008, pp. 214-224 (Year: 2008).*

Dufresne, "Nanocellulose: From Nature to High Performance Tailored Materials", Walter de Gruyter, Berlin, Germany, 2012.

Eichhorn et al., "Review: current international research into cellulose nanofibres and nanocomposites", Journal of Materials Science, 2010, vol. 45, No. 1, pp. 1-33.

Gabr et al., "Mechanical, thermal, and moisture absorption properties of nano-clay reinforced nano-cellulose biocomposites", Cellulose, 2013, vol. 20, pp. 819-826.

Gardner et al., "Polymer Nanocomposites from the Surface Energy Perspective: A Critical Review", Reviews of Adhesion Adhesives, 2013, vol. 1, No. 2, pp. 175 -215.

Lavoine et al., "Microfibrillated Cellulose—Its barrier properties and applications in cellulosic materials: A review", Carbohydrate Polymers, 2012, vol. 90, pp. 735-764.

Moon et al., "Cellulose nanomaterials review: structure, properties and nanocomposites", Chemical Society Reviews, 2011, vol. 40, pp. 3941-3994.

Nypelo et al., "Interactions Between Inorganic Nanoparticles and Cellulose Nanofibrils", Cellulose, 2012, vol. 19, pp. 779-792.

Siro et al., "Microfibrillated cellulose and new nanocomposite materials: a review", Cellulose, 2010, vol. 17, pp. 459-494.

Spigarelli et al., "Opportunities and challenges in carbon dioxide capture", Journal of CO2 Utilization, 2013, vol. 1, pp. 69-87.

Veigel et al., "Particle Board and Oriented Strand Board Prepared With Nanocellulose-Reinforced Adhesive", Journal of Nanomaterials, 2012, pp. 1-8.

* cited by examiner

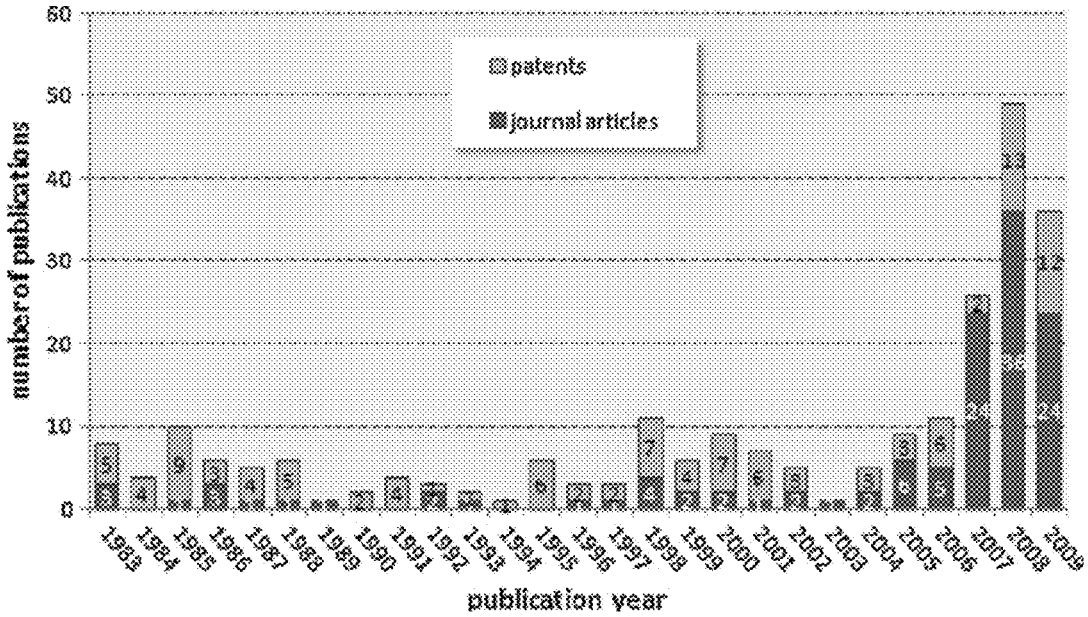
Fig. 1 (Siro Review, Fig. 1)
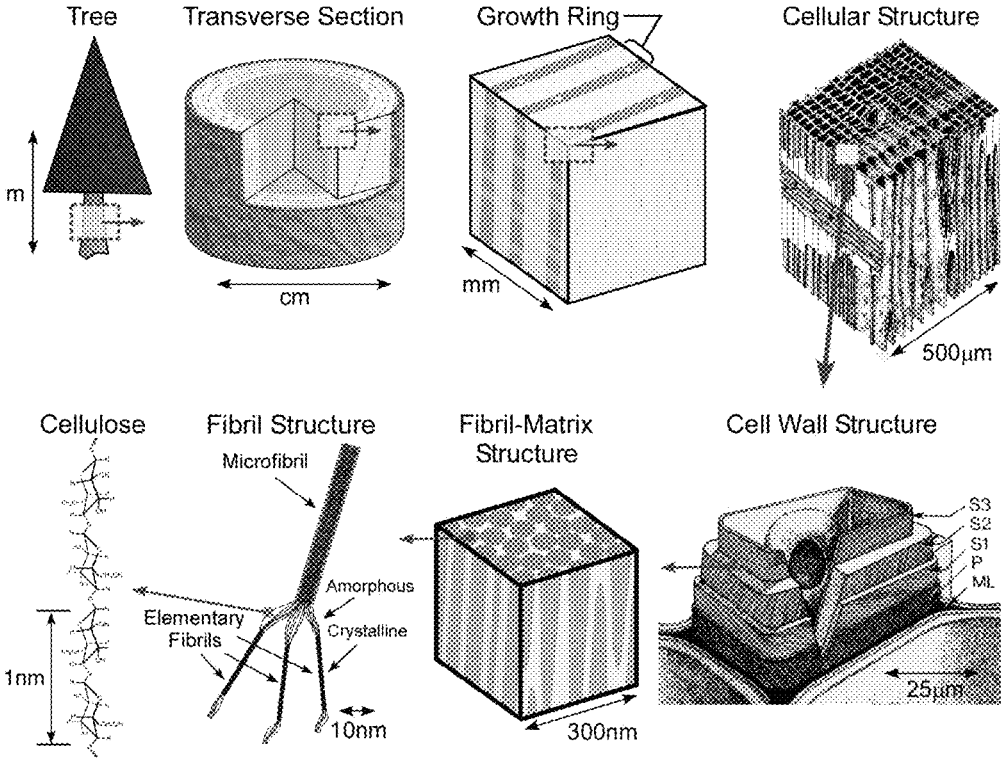
Fig. 2

COMPOSITE BUILDING PRODUCTS BOUND WITH CELLULOSE NANOFIBERS

RELATED APPLICATIONS

This application is a conversion of—and claims priority from—provisional application 61/860,533, filed Jul. 31, 2013.

BACKGROUND OF THE INVENTION

The present invention relates generally to the field of cellulosic pulp processing, and more specifically to building products such as particle board, wall board, pressed wood, oriented strand board (OSB), bound with nanocellulose fibers as the adhesive.

Capturing carbon from the air is a difficult and expensive task. A recent review article (See, Spigarelli B. P., and S. K. Kawatra, "*Opportunities and challenges in carbon dioxide capture*", J. of $CO_2$ Utilization 1: 69-87 (2013) documents the various approaches. The cost to simply remove $CO_2$ from stack gas is quite significant. For example, $CO_2$ can be scrubbed from stack gasses at low cost and precipitated with calcium to form calcium carbonate. However, the lime that is needed for this process is produced by burning calcium carbonate that results in the release of $CO_2$, there is no net reduction of $CO_2$ and in fact, the net result is a release of carbon from the fuel used to burn the limestone. Membrane processes require large capital investments and energy costs. Therefore, any product that is produced from $CO_2$ captured from a stack gas has the cost burden of capture on top of other process costs to convert it into a product.

Of course, plants sequester carbon as they grow. However, after a plant/tree dies, it will be burned or decompose, releasing the $CO_2$. Using plant material to produce biofuels is one method to reduce our use of petroleum, but $CO_2$ is released upon burning of these fuels. Only when we convert the carbon in the plant material into products that last a long time will a net reduction of $CO_2$ be realized.

The present invention seeks to reduce the release of $CO_2$ into the atmosphere by using the carbon found in plant material to produce useful building materials that will last several decades. Doing so utilizes carbon that is already sequestered by plants, and incorporates that carbon into novel and valuable products that will last for many years. Large quantities of carbon can be captured for many years into the future if even only some of the building products described herein are commercialized.

In the western US and Canada, there is a large infestation of pine beetle that has killed millions of square miles of lodge pole and other pines. As of 2006, the beetle had killed over 130,000 $km^2$ and is thought to be the largest insect tree kill in recorded history. The carbon that is sequestered in this wood may be in the order of 10,000 mtons. In addition, in the western US, thinning and clearing of forests are needed for fire prevention. However, there is no commercial use of this wood that can support the cost of thinning operations. If forest fires break out or as the natural decomposition of the wood occurs, this carbon will be released as $CO_2$. Dead trees are only good for saw timber for a few years. Its value then decreases rapidly. Once a tree falls, it will decompose and release the carbon. If this wood is converted into fuel or burned to generate heat or electricity, or involved in a forest fire, this carbon ends up in the atmosphere. It would be advantageous to avoid this result.

An additional but distinct environmental problem is the release of formaldehyde into living spaces. Conventional composite wood products such as particle board typically contain a formaldehyde-based binder system, which releases the dangerous formaldehyde into a living space. The release of formaldehyde into a living space causes respiratory disorders, neurological disorders, cancer, and reproductive issues.

According to the Formaldehyde Emissions Standards for Composite Wood Products; Proposed Rule [RIN 2070-AJ92; FRL-9342-3], the benefits of avoiding formaldehyde are substantial. "For the subset of health effects where the results were quantified, the estimated annualized benefits (due to avoided incidence of eye irritation and nasopharyngeal cancer) are $20 million to $48 million per year using a 3% discount rate, and $9 million to $23 million per year using a 7% discount rate. There are additional unquantified benefits due to respiratory and other avoided health effects." The "Alternative Resin Binders for Particleboard, Medium Density Fiberboard (MDF), and Wheatboard" report issued by the Global Health and Safety Initiative, indicates that no alternatives have been identified that are 100% safe. "At this point in the development of alternatives to urea formaldehyde (UF) resins in particleboard, MDF, and wheatboard products, there has yet to be a product that can replace UF that does not raise some environmental health concerns."

Nanofibrillated cellulose have been shown to be useful as reinforcing materials in wood and polymeric composites, as barrier coatings for paper, paperboard and other substrates, and as a paper making additive to control porosity and bond dependent properties. For example, a review article by Siro I., and D. Plackett, "*Microfibrillated cellulose and new nanocomposite materials: a review*", Cellulose 17:459-494 (2010) discusses recent trends. FIG. 1 from Siro et al (reproduced as FIG. 1 herein) illustrates the explosion of publications in this area recently. A number of groups are looking at the incorporation of nanocellulose materials into paper or other products, but commercial demonstration related to the use of this material has yet to be documented. Other research groups are looking at using this material at low concentrations as reinforcements in plastic composites. In these cases, the prevalent thinking is that nanofibers can be used in combination with the polymeric binder in composites, typically as reinforcement, not as a replacement adhesive in lieu of the polymers. For example, Veigel S., J. Rathke, M. Weigl, W. Gindl-Altmutter, in "*Particle board and oriented strand board prepared with nanocellulose-reinforced adhesive*", J. of Nanomaterials, 2012, Article ID 158503 1-8, (2012) discuss using nanocellulose to reinforce the polymeric resins, but still retain resins in the system. Many of the other ideas by other groups are only using small volumes of fibers in high value products.

It would be advantageous if there could be developed improved processes for sequestration of carbon to prevent the release of $CO_2$ into the atmosphere. It would also be advantageous if building products could be developed utilizing cellulose nanofibers that otherwise would be wasted or would release $CO_2$ into the atmosphere if used in conventional ways. It would be especially advantageous if building products having superior properties could be developed in the process.

SUMMARY OF THE INVENTION

One aspect of this invention is to incorporate cellulose nanofibers in lieu of conventional binders and adhesives into a variety of building products such as wallboard, paint, particle board, OSB, and cement. Low-cost cellulose nanofibers are a recent development with excellent potential to be a part of new products. The goal of the invention is to develop high volume, strong, economical products that use cellulose fibers. An environmental advantage of this invention is that it can result in the long term sequestration of carbon. Thus another aspect of the invention is to use this cellulosic carbon and oxygen, which is already captured and held by plants, in building products that will have long lifespans. This will keep this carbon from escaping back to the atmosphere. The use of "salvage" or "offgrade" wood that is not suitable for saw logs will ensure that carbon that would have reached the atmosphere in the near future, will not. This technology can be replicated around the world as well to convert carbon in biomass to valuable products.

A purpose of this invention is to use cellulose nanofibers as an adhesive system to produce particle board, wallboard, or other fiber board products that are free of formaldehyde. The boards have strength properties equal to or greater than conventional boards. The boards may be formed with one or more webs on the surface of the board. The invention may also be useful in the production of other wood based building products such as oriented strand board, plywood, wallboard, or formed/pressed wood products as well.

Cellulose nanofibers are produced by various methods such as intense refining, homogenizers, grinders, or microfluidic cells. Other methods of producing cellulose nanofibers have been proposed including chemical and/or enzymatic pretreatment followed by mechanical treatment such as ultrafine grinders, homogenizers, microfluidizers and other similar size reduction equipment. These fibers may be concentrated to a solids level of 10-20% by weight or used at the concentration at that they were made, often around 3% solids. The fiber suspension is mixed with wood chips, sawdust, or wood meal to form a thick material. The concentration, on a dry basis, can range from 50 to 95% wood with the balance being cellulose nanofibers. Other materials may also be added such as mineral fillers, water soluble polymers, latex, resins or cross-linkers. This material is formed into a board shape or any shape that is desired. The material is then dried. The resulting board or other shape can be further cut or machined into the shape or dimensions with standard tools. Initial tests show that the novel board product is 25% or more stronger than conventional particle board.

In one embodiment, the invention is a building product comprising: a particulate wood-derived material, and a binder holding the particulate wood-derived material in a defined matrix, the binder consisting essentially of cellulose nanofibers and moisture. Notably, the binder is formaldehyde-free and does not release formaldehyde into any living space. The particulate wood-derived material may comprise wood chips, wood shavings, wood meal, saw dust or other material, and may be present on a dry weight basis from about 50% to about 95%. The cellulose nanofibers (CNF) is present from about 5 to about 50% on a dry weight basis, but moisture is also present in the final product. The CNF may have a mean fiber length from about 0.2 mm to about 0.5 mm. The building product is typically formed and dried into a sheet or planar shape. The sheet may be less dense and yet exhibit a 3-point bending fracture strength that is higher than the same building product manufactured with a formaldehyde-based adhesive binder by as much 10%, 20%, 50% 100% or even more.

In various embodiments, the building product is a sheet of particle board, a sheet of OSB, a sheet of wallboard, or a sheet of fiber board.

In some embodiments, the building product may also contain a particulate mineral derived material. These mineral-derived materials may be selected from ground calcium carbonate, precipitated calcium carbonate, titanium dioxide, kaolin clay, calcined clay, water-washed clay, mica, graphite, graphene, calcium sulphate, bauxite, vermiculite, gilsonite, zeolite, montmorillonite, bentonite, silica, silicate, mineral wool, and borate.

In a particular embodiment, the building product is a particle board comprising:

a wood-derived particulate material, and a binder holding the wood-derived particulate material in a defined planar matrix, the binder consisting essentially of cellulose nanofibers and moisture, and excludes formaldehyde;

wherein the particle board exhibits a 3-point bending fracture strength at least 10% higher than the same building product manufactured with a formaldehyde-based adhesive binder.

The particle board in some embodiments exhibits a 3-point bending fracture strength at least 2 times higher than the same building product manufactured with a formaldehyde-based adhesive binder; yet it remains less dense.

In a different particular embodiment, the building product is a wallboard comprising:

a wood-derived particulate material, and a mineral-derived material selected from ground calcium carbonate, precipitated calcium carbonate, titanium dioxide, kaolin clay, calcined clay, water-washed clay, mica, graphite, graphene, calcium sulphate, bauxite, vermiculite, gilsonite, zeolite, montmorillonite, bentonite, silica, silicate, mineral wool, and borate, and the product is formed in to a planar sheet. The product may have one or more webs adhered to one or more of the surfaces.

In yet another aspect, the invention is a process for sequestering carbon and oxygen to reduce the amount of $CO_2$ released into the atmosphere, the process comprising:

converting wood into cellulose nanofibers; and incorporating said cellulose nanofibers into a building product as described above, whereby said carbon and oxygen will be retained in said building product for its lifespan.

Other advantages and features are evident from the following detailed description.

BRIEF DESCRIPTION OF THE DRAWINGS

The accompanying drawings, incorporated herein and forming a part of the specification, illustrate the present invention in its several aspects and, together with the description, serve to explain the principles of the invention. In the drawings, the thickness of the lines, layers, and regions may be exaggerated for clarity.

FIG. 1 is a chart showing the increase in publication recently relating to nanocellulose fibers. It is reproduced from FIG. 1 of Siro I., and D. Plackett, "*Microfibrillated cellulose and new nanocomposite materials: a review*", Cellulose 17:459-494 (2010).

FIG. 2 is a schematic illustration showing some of the components of a cellulosic fiber such as wood. It is reproduced from FIG. 1 of Moon R. J., A. Martini, J. Nairn, J. Simonsen, and J. Youngblood, *Cellulose nanomaterials review: structure, properties and nanocomposites*, Chem. Soc. Rev. 40: 3941-3994 (2011).

Figure 3:
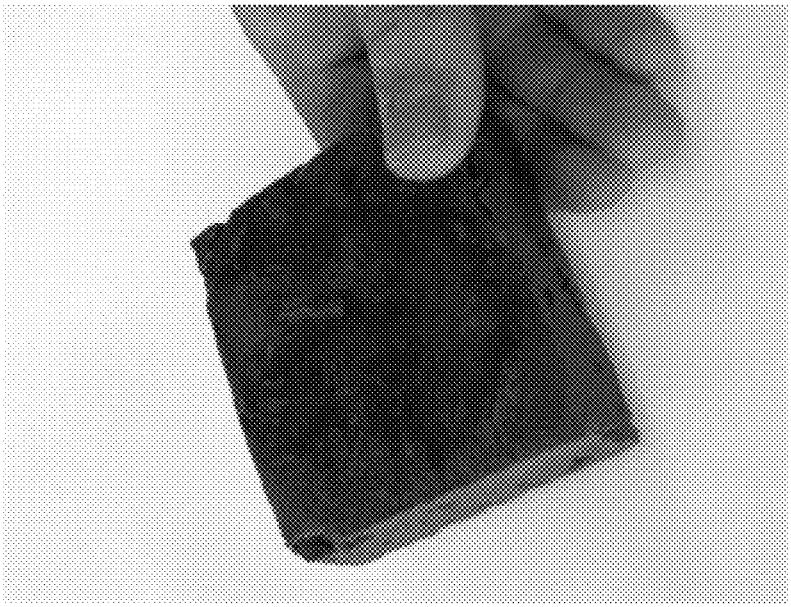
FIG. 3 is photograph of a wallboard embodiment of the invention.

Various aspects of this invention will become apparent to those skilled in the art from the following detailed description of the preferred embodiment, when read in light of the accompanying drawings.

DETAILED DESCRIPTION

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are described herein. All references cited herein, including books, journal articles, published U.S. or foreign patent applications, issued U.S. or foreign patents, and any other references, are each incorporated by reference in their entireties, including all data, tables, figures, and text presented in the cited references.

Numerical ranges, measurements and parameters used to characterize the invention—for example, angular degrees, quantities of ingredients, polymer molecular weights, reaction conditions (pH, temperatures, charge levels, etc.), physical dimensions and so forth—are necessarily approximations; and, while reported as precisely as possible, they inherently contain imprecision derived from their respective measurements. Consequently, all numbers expressing ranges of magnitudes as used in the specification and claims are to be understood as being modified in all instances by the term "about." All numerical ranges are understood to include all possible incremental sub-ranges within the outer boundaries of the range. Thus, a range of 30 to 90 units discloses, for example, 35 to 50 units, 45 to 85 units, and 40 to 80 units, etc. Unless otherwise defined, percentages are wt/wt %.

Nanocellulose fibers (NCF) are also known in the literature as microfibrillated cellulose (MCF), cellulose microfibrils (CMF) and cellulose nanofibrils (CNF). Despite this variability in the literature, the present invention is applicable to microfibrillated fibers, microfibrils and nanofibrils, independent of the actual physical dimensions; and all these terms may be used essentially interchangeably in this disclosure. They are generally produced from wood pulps by a refining, grinding, or homogenization process, described below, that governs the final length. The fibers tend to have at least one dimension (e.g. diameter) in the nanometer range, although fiber lengths may vary from 0.1 mm to as much as about 4.0 mm depending on the type of wood or plant used as a source and the degree of refining. In some embodiments, the "as refined" fiber length is from about 0.2 mm to about 0.5 mm. Fiber length is measured using industry standard testers, such as the TechPap Morphi Fiber Length Analyzer. Within limits, as the fiber is more refined, the % fines increases and the fiber length decreases.

"Building Products" as used herein, refers to composite materials that are typically used in the construction or fabrication of homes and buildings, whether on-site or manufactured-style homes, that are designed and intended to last for decades. Examples of building products include but are not limited to composites like: (1) particle board, OSB, or plywood, such as might be used in flooring, roofing and structural rigidity in walls, and in "I-beam" joists and rafters; (2) fiber or wafer board, such as might be used for insulation in walls and in some suspended ceilings; (3) drywall, sheetrock, gypsum or wallboard, such as is typically used on interior walls and ceilings; (4) pressed wood, such as might be used in some casings, baseboards, shoe molding and other trim pieces; (5) paints, interior or exterior, water- or oil-based, including latexes, alkyds, etc.; and (6) cements, such as might be used in foundations, footings, driveways, patios, porches, steps, sidewalks and other pathways, retaining walls and other landscape features.

Cellulosic and Wood-Derived Materials

Cellulose, the principal constituent of "cellulosic materials," is the most common organic compound on the planet. The cellulose content of cotton is about 90%; the cellulose content of wood is about 40-50%, depending on the type of wood. "Cellulosic materials" includes native sources of cellulose, as well as partially or wholly delignified sources. Wood pulps are a common, but not exclusive, source of cellulosic materials. Tree limbs, fallen trees, diseased trees, etc, are also good sources of wood derived particulate materials. "Salvage" woods, those that otherwise would simply decay or be burned to release carbon dioxide, are especially useful, but certainly not the only sources of wood derived materials.

FIG. 2 presents an illustration of some of the components of wood, starting with a complete tree in the upper left, and, moving to the right across the top row, increasingly magnifying sections as indicated to arrive at a cellular structure diagram at top right. The magnification process continues downward to the cell wall structure, in which S1, S2 and S3 represent various secondary layers, P is a primary layer, and ML represents a middle lamella. Moving left across the bottom row, magnification continues up to cellulose chains at bottom left. The illustration ranges in scale over 9 orders of magnitude from a tree that is meters in height through cell structures that are micron (μm) dimensions, to microfibrils and cellulose chains that are nanometer (nm) dimensions. In the fibril-matrix structure of the cell walls of some woods, the long fibrils of cellulose polymers combine with 5- and 6-member polysaccharides, hemicelluloses and lignin.

It is evident from FIG. 2 that trees can provide both the wood-derived materials and the cellulose nanofibers used in the present invention. "Wood-derived materials" refers to the chips, clippings, shavings, wood meal, saw dust, or other wood particles that can be created from trees. For coarser board applications, the particles sizes will typically lie within the range 8 to 150 mesh, but with a substantial portion (e.g. >60%) of the particles lying within the range 10 to 60 mesh. In the case of finer or smoother board products, the substantial portion (e.g. >60%) of the particles typically lie within the range of 5 to 30 mesh. The moisture content of the boards will be low, preferably less than 10% by weight and more often from about 2% to about 8% by weight.

Cellulose, with its beta (1-4)-glycosidic bonds, is a straight chain polymer: unlike starch, no coiling or branching occurs, and the molecule adopts an extended and rather stiff rod-like conformation, aided by the equatorial conformation of the glucose residues. The multiple hydroxyl groups on a glucose molecule from one chain form hydrogen bonds with oxygen atoms on the same or on a neighbor chain, holding the cellulose chains firmly together side-by-side and forming elementary nanofibrils. Cellulose nanofibrils (CNF) are similarly held together in larger fibrils known as microfibrils; and microfibrils are similarly held together in bundles or aggregates in the matrix as shown in FIG. 2. These fibrils and aggregates provide cellulosic materials with high tensile strength, which is important in cell walls conferring rigidity to plant cells. While crystalline cellulose itself does not branch, the fibrils may contain amorphous areas in which the regular crystalline structure is sufficiently varied to allow for branching of fibrils and microfibrils.

As noted, many woods also contain lignin in their cell walls, which give the woods a darker color. Thus, many wood pulps are bleached and/or degraded to whiten the pulp for use in paper and many other products. The lignin is a three-dimensional polymeric material that bonds the cellulosic fibers and is also distributed within the fibers themselves. Lignin is largely responsible for the strength and rigidity of the plants.

For industrial use, cellulose is mainly obtained from wood pulp and cotton, and largely used in paperboard and paper. However, the finer cellulose nanofibrils (CNF) or microfibrillated cellulose (MFC), once liberated from the woody plants, are finding new uses in a wide variety of products as described below.

Other Materials

In some products such as wallboards, the wood-derived materials may be combined with mineral-derived materials. Useful mineral-derived materials include calcium carbonate, whether ground or precipitated, titanium dioxide, kaolin clay, calcined clay, water-washed clay, mica, apatite, hydroxyapatite, graphite, graphene, calcium sulphate, bauxite, vermiculite, gilsonite, zeolite, montmorillonite, bentonite, silica, silicate, mineral wool, borate, gypsum, and other similar materials.

Mineral-derived materials may be present in suitable building products on a dry weight basis in a range from about 10% to about 50%, more often from about 20% to about 35%.

Aggregates are a well known and essential component of concrete. Aggregates are inert granular materials such as sand, gravel, pebbles or crushed stone that, along with water and portland cement, form concrete. Aggregates should be clean, hard, strong particles free of absorbed chemicals or coatings of clay and other fine materials that could cause the deterioration of concrete. Aggregates, which account for 60 to 75 percent of the total volume of concrete, are divided into two distinct categories—fine and coarse. Fine aggregates generally consist of natural sand or crushed stone with most particles passing through a ⅜-inch sieve. Coarse aggregates are any particles greater than 0.19 inch, but generally range between ⅜ and 1.5 inches in diameter. Gravels constitute the majority of coarse aggregate used in concrete with crushed stone making up most of the remainder.

Pigments are also well known and understood insoluble particulate components of paints.

General Pulping and MCF Processes

Wood is converted to pulp for use in paper manufacturing. Pulp comprises wood fibers capable of being slurried or suspended and then deposited on a screen to form a sheet of paper. There are two main types of pulping techniques: mechanical pulping and chemical pulping. In mechanical pulping, the wood is physically separated into individual fibers. In chemical pulping, the wood chips are digested with chemical solutions to solubilize a portion of the lignin and thus permit its removal. The commonly used chemical pulping processes include: (a) the Kraft process, (b) the sulfite process, and (c) the soda process. These processes need not be described here as they are well described in the literature, including Smook, Gary A., Handbook for Pulp & Paper Technologists, Tappi Press, 1992 (especially Chapter 4), and the article: "Overview of the Wood Pulp Industry," Market Pulp Association, 2007. The kraft process is the most commonly used and involves digesting the wood chips in an aqueous solution of sodium hydroxide and sodium sulfide. The wood pulp produced in the pulping process is usually separated into a fibrous mass and washed.

The wood pulp after the pulping process is dark colored because it contains residual lignin not removed during digestion. The pulp has been chemically modified in pulping to form chromophoric groups. In order to lighten the color of the pulp, so as to make it suitable for white paper manufacture and also for further processing to nanocellulose or MFC, the pulp is typically, although not necessarily, subjected to a bleaching operation which includes delignification and brightening of the pulp. The traditional objective of delignification steps is to remove the color of the lignin without destroying the cellulose fibers. The ability of a compound or process to selectively remove lignins without degrading the cellulose structure is referred to in the literature as "selectivity."

A generalized process for producing nanocellulose or fibrillated cellulose is disclosed in PCT Patent Application No. WO 2013/188,657, which is herein incorporated by reference in its entirety. The process includes a step in which the wood pulp is mechanically comminuted in any type of mill or device that grinds the fibers apart. Such mills are well known in the industry and include, without limitation, Valley beaters, single disk refiners, double disk refiners, conical refiners, including both wide angle and narrow angle, cylindrical refiners, homogenizers, microfluidizers, and other similar milling or grinding apparatus. These mechanical comminution devices need not be described in detail herein, since they are well described in the literature, for example, Smook, Gary A., Handbook for Pulp & Paper Technologists, Tappi Press, 1992 (especially Chapter 13). Tappi standard T200 describes a procedure for mechanical processing of pulp using a beater. The process of mechanical breakdown, regardless of instrument type, is sometimes referred to in the literature as "refining", but it is also referred to generically as "comminution."

The extent of comminution may be monitored during the process by any of several means. Certain optical instruments can provide continuous data relating to the fiber length distributions and percent fines, either of which may be used to define endpoints for the comminution stage. Within limits, as the fiber is more refined, the % fines increases and the fiber length decreases. Fiber length is measured using industry standard testers, such as the TechPap Morphi Fiber Length Analyzer, which reads out a particular "average" fiber length. In some embodiments, the "as refined" fiber length is from about 0.1 mm to about 0.6 mm, or from about 0.2 mm to about 0.5 mm.

A number of mechanical treatments to produce highly fibrillated cellulose have been proposed, including homogenizers and ultrafine grinders. However, the amount of energy required to produce fibrillated cellulose using these devices is very high and is a deterrent to commercial application of these processes for many applications. U.S. Pat. No. 7,381,294 (Suzuki et al.) describes the use of low consistency refiners to produce fibrillated cellulose. Low consistency refiners are widely used in the paper industry to generate low levels of fiber fibrillation. Suzuki teaches that microfibrillated cellulose can be produced by recirculating fiber slurry through a refiner. However, as many as 80 passes through the refiner may be needed, resulting in very high specific energy consumption, for both pumping and refiner operations. Suzuki discloses that, under the conditions specified in U.S. Pat. No. 7,381,294, the refiner operates at very low energy efficiency during the processing of the slurry. Also, the lengthy time required to process the pulp to the desired end result contributes to the high energy consumption. Suzuki teaches that, for the preferred method of using two refiners sequentially, the first refiner should be outfitted with refiner disc plates with a blade width of 2.5 mm or less and a ratio of blade to groove width of 1.0 or less. Refiner disc plates with these dimensions tend to produce refining conditions characterized by low specific edge load, also known in the art as "brushing" refining, which tends to promote hydration and gelation of cellulose fibers.

Enzymatic and/or chemical pretreatments have reduced the energy consumption required to comminute cellulose to MFC (see, e.g. PCT patent publication WO2013/188657 A1). It has further been found by researchers at the University of Maine that specific arrangements of the mechanical comminution devices can achieve an unexpected reduction in the energy requirements of the process, thereby lowering overall manufacturing costs. The method consists of processing a slurry of cellulosic fibers, preferably wood fibers, which have been liberated from the lignocellulosic matrix using a pulping process. The pulping process can be a chemical pulping process such as the sulphate (Kraft) or sulfite process as described above. The process includes first and second mechanical refiners which apply shear to the fibers. The refiners can be low consistency refiners. The shear forces help to break up the fiber's cell walls, exposing the fibrils and nanofibrils contained in the wall structure. As the total cumulative shear forces applied to the fibers increase, the concentration of nanofibrils released from the fiber wall into the slurry increases. The mechanical treatment continues until the desired quantity of fibrils is liberated from the fibers. While not essential to the present invention, it makes the manufacturing process more economical. This is described in more detail in U.S. provisional application 61/989,893 filed May 7, 2014 and incorporated herein. This process has been well developed in the last couple of years at the University of Maine, which is operating a pilot scale production of cellulose nanofibers with a scale of one dry ton per day. The unique aspect of this work is that the process requires low energy input to produce a low cost material with no side products.

Industrial Uses of Nanocellulose Fibers

Nanocellulose fibers still find utility in the paper and paperboard industry, as was the case with traditional pulp. However, their rigidity and strength properties have found myriad uses beyond the traditional pulping uses. Cellulose nanofibers have a surface chemistry that is well understood and compatible with many existing systems; and they are commercially scalable. For example, nanocellulose fibers have previously been used to strengthen coatings, barriers and films. Composites and reinforcements that might traditionally employ glass, mineral, ceramic or carbon fibers, may suitably employ nanocellulose fibers instead.

Now, new applications for carbon dioxide sequestering material using nanocellulose fibers as adhesives and binders include but are not limited to four key products: 1) a novel wall board or "drywall" similar to gypsum wall board, that is lighter, stronger, and has significant thermal resistance and sound attenuation; 2) a binder for paint that would reduce the need for petroleum based binders; 3) a new particle board or other composite wood product that will be lighter, stronger, and formaldehyde-free; and 4) an additive into cement that will increase the strength of cement. Each of these applications is novel, and has the potential to incorporate large quantities of nanocellulose fibers, thereby fixing carbon that would otherwise end up in the atmosphere into long-term products. These building products according to the invention have at least two main ingredients: (a) a base particulate material that serves as a bulking or filler agent, and (b) a CNF binder. In some embodiments the base particulate is also cellulosic material, such as wood-derived material like wood chips, shavings, saw dust, wood meal and the like. Such products thus have the potential to sequester a great deal of carbon via both cellulosic components.

The amount of cellulose nanofibers used as a binder in the present invention may vary on a dry weight percent basis from a low of about 3-5% to a high of about 50% or more. More restrictive ranges of percent nanocellulose useful as binder depends on the type of building product under consideration. Table 1 provides some useful guidance for % nanocellulose as binder in various products.

TABLE 1

Representative Building Product Compositions (dry weight basis)

| | Particle Board/ Pressed Bd/ OSB | Wallboard/ Sheetrock/ Gypsum | Paint | Cement |
|---|---|---|---|---|
| Base particulate material | wood meal, chips, sawdust, etc | wood meal, chips, sawdust, etc clay, minerals, oil sands tailings, etc | pigments latex or resin | aggregate, sand |
| wt % dry | 50-95% | 70-95% collectively | 60-90% | 60-95% |
| Cellulose Nanofiber Binders | | | | |
| wt % dry | 5-50% | 5-30% | 10-40% | 5-40% |

The method of production of cellulose nanofibers, as developed at the University of Maine, has no environmental effects. No chemicals are used in the production. Off grade, beetle killed, or thinning "salvage" wood sources can be used. Recycled paper streams can also be used as a source. There are no by-products in the production of these nanofibers. The proposed uses above do not generate any byproducts. The net result of using these materials is the conversion of cellulose that will at some point break down to release CO2, into a useful product in the construction industry.

As demonstrated in the examples that follow, building materials made with cellulose nanofibers as binder have the potential to be stronger and lighter than the conventional alternatives that they might replace. At least for certain "planar" or "sheet" products, this appears to be true. Table 2 below gives density data for certain sheet-like building products made according to the invention and for their conventional alternatives as well. It can be seen that the product made with cellulose nanofibers as binder are less dense and therefore lighter weight alternatives. As seen from the examples, the strength for certain of these building products also exceeds that of their conventional counterparts.

TABLE 2

Representative Building Product Densities

| Product Composition | Density (lb/ft$^3$) |
|---|---|
| 90% wood-10% CNF | 17 |
| 70% wood-30% CNF | 20 |
| 50% wood-50% CNF | 16 |
| 100% CNF | 46 |
| Drywall, typical | 39 |
| Particle Board, typical | 54 |
| 50% sand, 50% CNF | 70 |

While care must be taken with any material that is produced with length scales in the nanometer range, all toxicology tests to date, with both the chemically and mechanically produced fibers have shown no issues. That is likely a result from our contact with cellulose in many forms: when we eat plant material, our digestive system likely breaks down the crystalline cellulose down to the nano-scale. When dried, often the fibers clump to each other, resulting in micron scale features.

EXAMPLES OF BUILDING PRODUCTS

Example 1

Wallboard or Drywall

A wall board product is produced having using cellulose nanofibers as an adhesive binder for minerals, such as kaolin or calcium carbonate. When dried, this blend creates a strong material. Tests have demonstrated that even tailings from oil sands processing can be used as the mineral source: FIG. 3 shows a board sample that contains cellulose nanofibers and tailings from Alberta oil sands. "Tailings" are made up of natural materials including fine silts, residual bitumen, salts and soluble organic compounds and solvent remaining after the oils are extracted. This sample is stronger than regular gypsum wall board even without the kraft paper cover.

The key costs are the transportation of the biomass to the facility, the energy to produce the nanofibers, the energy to dry the combination, and the shipping of the final product. Initial estimates of these costs give a cost similar to that for current gypsum wall board. The potential for sequestering of carbon is large: the North American consumption of drywall is 40×109 $ft^2$/yr. Assuming 100% of this market; an area board density of 1.2 lbs/$ft^2$; of which 20% of the composition is cellulose; and knowing that cellulose is 44% carbon by weight; an estimate of sequestration of carbon dioxide would be about 7.7 million tons per year.

The economics are reasonable as well with a price per board near the current market price. The lifecycle of this is better than conventional gypsum wallboard in that less fossil fuel energy would be needed per unit product. In addition, this wall board if put in a landfill would decompose into a soil rich in organics. The density of the product can be adjusted. A board that has a low thermal conductivity compared to conventional wallboard would save energy by reducing thermal losses from exterior walls.

A lighter wall board that is stronger than conventional wall board makes the cost of the fibers a minor point. For example, a sheet of board that is 20% lighter, reduces the raw material costs, transportation costs and drying costs. In addition, installers of the board may prefer this lighter product. Assuming a current market price for bleached kraft pulp, the cost of producing cellulose nanofibers at $800/dry ton; although this might be reduced significantly if recovered paper was used as a source. At 20% of 40 lbs for a sheet of product would come to $3.2/sheet. This value is about 30% of the costs of a current sheet of material, but now a 20% savings in materials would closely cover the extra cost of the fibers.

Example 2

Paint

Figure 4:
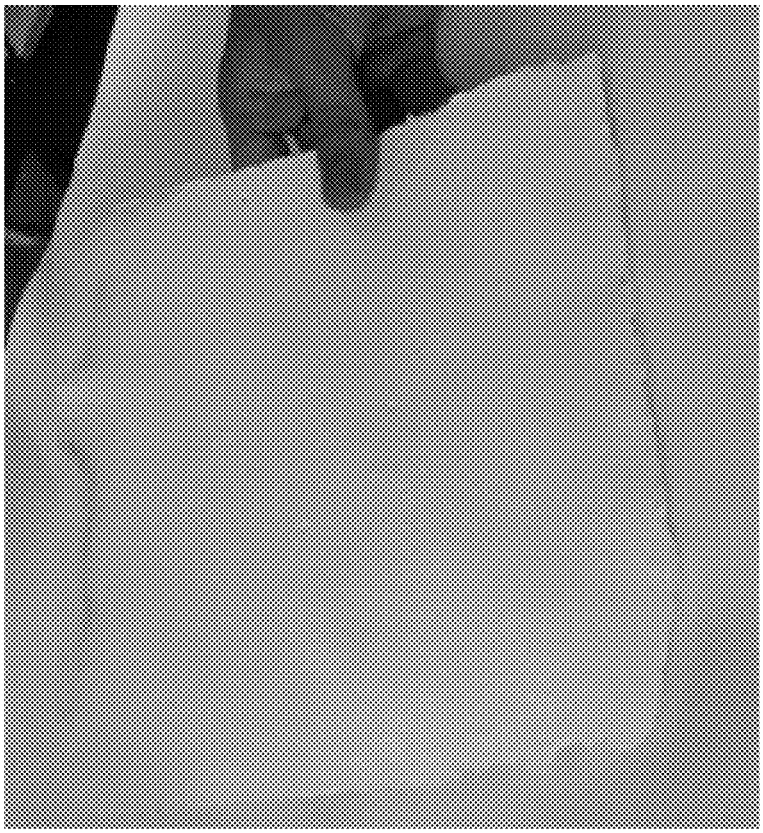
FIG. 4 is photograph of a paint film embodiment of the invention.

The addition of cellulose nanofibers into paint offers some potential benefits in terms of paint durability, reduction of binder costs, rheology control and compatibility with wood. The paint market represents 7.8 billion pounds of dry solids per year worth $23 billion. If cellulose nanofibers composed 10% of these solids, the capture of carbon would represent 0.6 million tons of carbon dioxide per year. FIG. 4 shows a film of material that has pigments similar to that of a paint mixed with 30% by weight cellulose nanofibers. This film has a higher elastic modulus compared to films produced with latex binder. Almost certainly these paint films would have higher resistance to scratches and abrasion than paint films that only contain latex.

In paint formulated with 10% less latex, the cost of the latex is replaced by the cost of the cellulose fibers, which are about half the cost of the latex. Therefore, the paint formulator will have a lower cost paint that is more durable than conventional paint.

Example 3

Particle Board

Another application of this material is in particle board, pressed, board, and oriented strand board. Particle board is currently held together with a melamine-formaldehyde resin. The US alone consumes 100 million tons/year of such particle board. While various fiber sources have been shown to make good board, all still use resins that are formaldehyde-based and release formaldehyde. Formaldehyde is known to be harmful to human health. Tests and methods in our labs have shown that the cellulose made in our lab has the potential to completely replace these resins. If the use of the resin is reduced 20% by weight, this application would represent the sequestration of 32.3 million tons/year of carbon.

Board manufacture: Wood meal (W) was obtained from the Advanced Wood Composites Center at the University of Maine. It was considered a typical wood meal that is used to produce particle board. The cellulose nanofibers (CNF) were produced at the Process Development Center at the University of Maine by a single disk refiner. The fibers were a typical market bleached kraft softwood fiber. The fibers is dispersed into water at around 3% solids and circulated through the refiner until the fines content is over 93%. The refiner has special controls and refiner plates. The precipitated calcium carbonate (PCC) was obtained from IMERYS with an average particle size in the micron size range. Starch was obtained from Tate and Lyle.

The samples were mixed in various levels of addition and formed into board samples approximately ½ inch in thickness. The samples were air dried for at least two days before testing. The various sample compositions are shown in Table 3 below.

TABLE 3

Board Compositions (dry weight %)

| Sample Identifier | wood meal (W) | cellulose nanofibers (NCF) | precipitated $CaCO_3$ (PCC) | starch (STC) |
|---|---|---|---|---|
| 50W50CNF | 50 | 50 | 0 | 0 |
| 70W30CNF | 70 | 30 | 0 | 0 |
| 80W20CNF | 80 | 20 | 0 | 0 |
| 90W10NCF | 90 | 10 | 0 | 0 |
| 60W10NCF30PCC | 60 | 10 | 30 | 0 |
| 70W20NCF10PCC | 70 | 20 | 10 | 0 |
| 80W10NCF10PCC | 80 | 10 | 10 | 0 |

TABLE 3-continued

| Board Compositions (dry weight %) | | | | |
|---|---|---|---|---|
| Sample Identifier | wood meal (W) | cellulose nanofibers (NCF) | precipitated $CaCO_3$ (PCC) | starch (STC) |
| 85W10NCF05PCC | 85 | 10 | 5 | 0 |
| 80W10NCF10STC | 80 | 10 | 0 | 10 |

Figure 5:
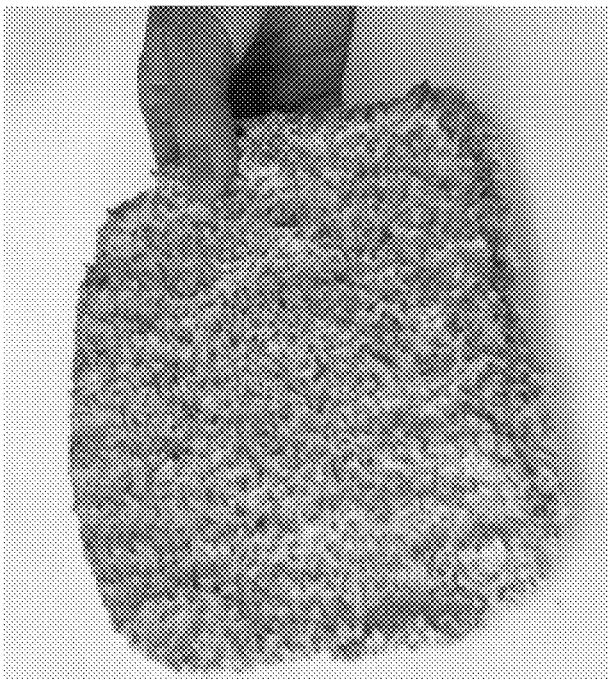
FIG. 5 is photograph of a particle board embodiment of the invention.

FIG. 5 shows a particle board sample that has been produced in our laboratory that uses only cellulose nanofibers as the binder.

Strength Testing: Board strength was tested initially using a "3-point bending fracture" test on an Instron 5966 as is well known in the art. A specimen of width B and thickness W is placed across a span S between two supports. A cut or crack of length a (a<W) is made in the underside of the specimen at the midpoint of the span S. Load P is presented on the top surface of the specimen above the crack, a. The displacement-controlled load (rate of 20 mm/min) is applied on the specimen until it breaks, and the maximum load (PQ) is used to calculate fracture toughness ($K_Q$):

$$K_Q = \frac{sP_Q}{BW^{\frac{3}{2}}} f(a/W),$$

where the factor shape, f(a/w) for rectangular specimens can be calculated as the equation below:

$$f\left(\frac{a}{W}\right) = \frac{3\sqrt{\frac{a}{W}}}{2\left(1+2\frac{a}{W}\right)\left(1-\frac{a}{W}\right)^{3/2}}\left[1.99-\frac{a}{W}\left(1-\frac{a}{W}\right)\left(2.15-3.93\frac{a}{W}+2.7\left(\frac{a}{W}\right)^2\right)\right].$$

Figure 6:
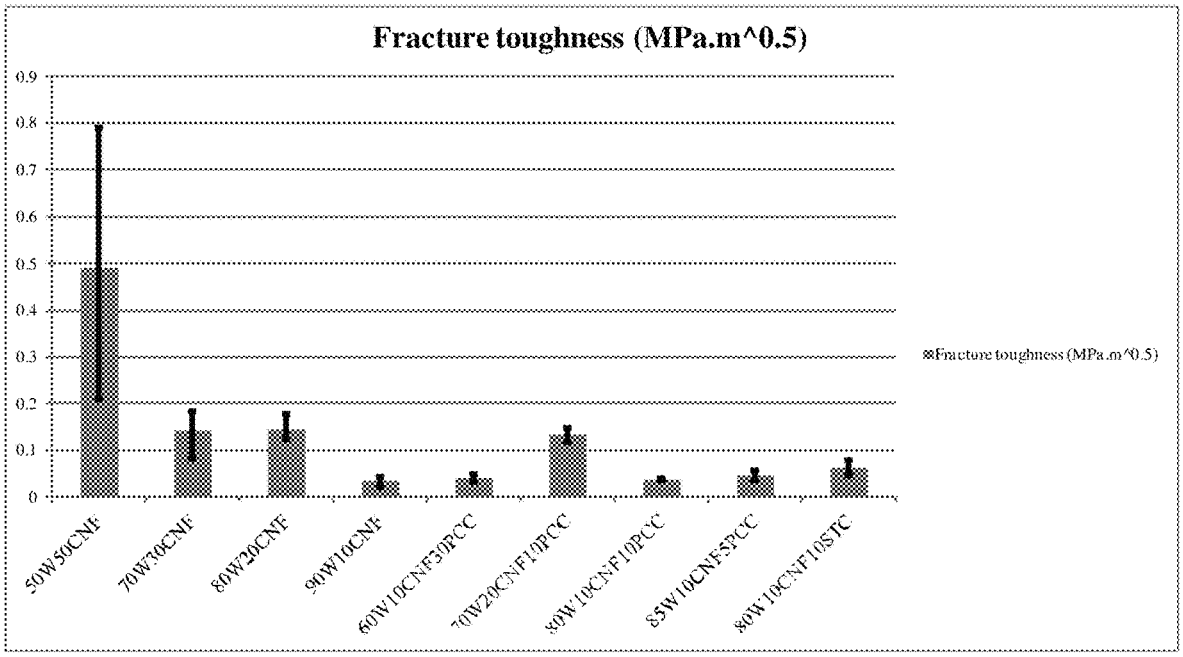
FIG. 6 is a chart of data from Example 3.

The axial load and deflection were recorded during the test. FIG. 6 charts the summary load results for the various boards identified in Table 3. For comparison, the typical fracture toughness for a representative melamine-urea-formaldehyde resin particle board is reported to be around 0.05 $MPa \cdot m^{1/2}$. (See Veigel S., J. Rathke, M. Weigl, W. Gindl-Altmutter, in "*Particle board and oriented strand board prepared with nanocellulose-reinforced adhesive*", J. of Nanomaterials, 2012, Article ID 158503 1-8, (2012).

The present invention containing a 50/50 mixture result is impressive, with an average value of 0.5 $MPa \cdot m^{1/2}$. This is a factor of ten times the comparison board. The board strength decreases as the wood content increases; thus 80% wood and 20% CNF gives a result that is 2.5 times larger than the standard board, but at 90% wood 10% CNF, the result is less than the standard at 0.034 $MPa \cdot m^{1/2}$. The combination of 70% wood, 20% CNF and 10% PCC also gave results that are over twice of the standard. The combination of 80% wood, 10% CNF and 10% starch gave results that are about 20% more than the standard. In addition, this sample does not release formaldehyde.

Example 4

Oriented Strand Board

Example 3 is repeated except larger wood chips are used instead of wood meal, resulting in an oriented strand board (OSB).

Example 5

Cement

Studies have shown that the use of cellulose nanofibers in cement increases the impact resistance. The incorporation of this material into cement would be simple: during the mix with water, replace plain water with water that contains the suspended fibers. In the USA, cement use has dropped in the last few years due to low housing starts, but it still averages around 100 Mt/year. If the nanofibers are used at a level of 5% by weight, this would represent a carbon dioxide capture of 8.1 million tons per year.

The foregoing description of the various aspects and embodiments of the present invention has been presented for purposes of illustration and description. It is not intended to be exhaustive of all embodiments or to limit the invention to the specific aspects disclosed. Obvious modifications or variations are possible in light of the above teachings and such modifications and variations may well fall within the scope of the invention as determined by the appended claims when interpreted in accordance with the breadth to which they are fairly, legally and equitably entitled.

What is claimed is:

1. A particle board building product consisting of:

a binder holding a wood-derived particulate material in a defined planar matrix, wherein the binder excludes formaldehyde and consists only of moisture and liberated cellulose nanofibers having a diameter in the nanometer range, and wherein the wood-derived particulate material has a mesh size of from 10 to 60 mesh;

wherein the cellulose nanofibers are present in the defined matrix in an amount of from about 30% to about 50% of the defined matrix on a dry weight basis.

2. The particle board building product of claim 1, wherein the cellulose nanofibers are present in the defined matrix in an amount of about 50% of the defined matrix on a dry weight basis.

3. The particle board building product of claim 1, wherein the cellulose nanofibers have a mean fiber length from about 0.2 mm to about 0.5 mm.

4. The particle board building product of claim 1, wherein the particle board exhibits a 3-point bending fracture strength at least 10% higher than the same building product manufactured with a formaldehyde-based adhesive binder.

5. The particle board building product of claim 1, wherein the wood-derived particulate material is selected from wood chips, wood shavings, wood dust, wood meal, and saw dust.

6. The particle board building product of claim 1, wherein the cellulose nanofibers are liberated by mechanical refining and are not chemically modified.

7. The particle board building product of claim 1, wherein the building product is stronger, or lighter weight, or both, than the same building product made with a formaldehyde-based binder.

8. The particle board building product of claim 1, wherein the wood-derived particulate base material further comprises starch or precipitated calcium carbonate.

* * * * *